US009497815B2

(12) United States Patent
Shaffer

(10) Patent No.: US 9,497,815 B2
(45) Date of Patent: Nov. 15, 2016

(54) METHODS AND APPARATUS FOR INTERPOLATING LOW FRAME RATE TRANSMISSIONS IN LIGHTING SYSTEMS

(71) Applicant: KONINKLIJKE PHILIPS N.V., Eindhoven (NL)

(72) Inventor: Maximillan Ben Shaffer, Arlington, MA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 183 days.

(21) Appl. No.: 14/381,308

(22) PCT Filed: Feb. 22, 2013

(86) PCT No.: PCT/IB2013/051456

§ 371 (c)(1),
(2) Date: Aug. 27, 2014

(87) PCT Pub. No.: WO2013/128353

PCT Pub. Date: Sep. 6, 2013

(65) Prior Publication Data

US 2015/0123560 A1 May 7, 2015

Related U.S. Application Data

(60) Provisional application No. 61/605,227, filed on Mar. 1, 2012.

(51) Int. Cl.
*H05B 33/08* (2006.01)
*H05B 37/02* (2006.01)

(52) U.S. Cl.
CPC ..... *H05B 33/0845* (2013.01); *H05B 33/0896* (2013.01); *H05B 37/0254* (2013.01); *H05B 37/0281* (2013.01)

(58) Field of Classification Search
CPC ..... H05B 33/0845; H05B 33/0896; H05B 37/0254; H05B 37/0281
USPC ..... 315/291, 307
See application file for complete search history.

(56) References Cited

U.S. PATENT DOCUMENTS

| | | | | |
|---|---|---|---|---|
| 7,228,190 | B2 | 6/2007 | Dowling et al. | |
| 2005/0151489 | A1 | 7/2005 | Lys et al. | |
| 2006/0158461 | A1 | 7/2006 | Reese et al. | |
| 2006/0241864 | A1* | 10/2006 | Rosenberg | G06F 3/04883 701/469 |
| 2007/0242162 | A1 | 10/2007 | Gutta et al. | |
| 2008/0204438 | A1 | 8/2008 | Song et al. | |

(Continued)

FOREIGN PATENT DOCUMENTS

| | | | |
|---|---|---|---|
| JP | 2001343900 | A | 12/2001 |
| JP | 14/381308 | A | 12/2008 |

*Primary Examiner* — Daniel D Chang
(74) *Attorney, Agent, or Firm* — Meenakshy Chakravorty

(57) ABSTRACT

Methods and apparatus, including computer program products, for interpolating low frame rate transmissions in lighting systems. A method (100) includes, in a microcontroller (22) of a light fixture (14), receiving (102) input data frames at a low frame rate from a light controller (12) over a data bus (16), generating (104) output data frames from any two adjacent input data frames according to a scaling scaling in a lookup table (LUT), and transmitting (106) the output data frames at a frame rate greater than the frame rate of the received input data frames to control a lighting effect of a light-emitting unit (24).

19 Claims, 4 Drawing Sheets

(56) References Cited

U.S. PATENT DOCUMENTS

| | | | |
|---|---|---|---|
| 2011/0084628 | A1 | 4/2011 | Welten et al. |
| 2011/0137757 | A1 | 6/2011 | Paolini et al. |

* cited by examiner

METHODS AND APPARATUS FOR INTERPOLATING LOW FRAME RATE TRANSMISSIONS IN LIGHTING SYSTEMS

CROSS-REFERENCE TO PRIOR APPLICATIONS

This application is the U.S. National Phase application under 35 U.S.C. §371 of International Application No. PCT/IB13/051456, filed on Feb. 22, 2013, which claims the benefit of U.S. Provisional Patent Application No. 61/605,227, filed on Mar. 1, 2012. These applications are hereby incorporated by reference herein.

FIELD OF THE INVENTION

The present invention generally relates to lighting systems, and more particularly to interpolating low frame rate transmissions in lighting systems.

BACKGROUND OF THE INVENTION

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects.

In lighting systems such as those that include LED-based light sources, it is desirable to have control over one or more light sources of the lighting system. Control of one or more light sources enables specification of lighting parameters for an environment. For example, a user may directly specify one or more lighting parameters of one or more light sources. Also, for example, the user may specify the effect that is desired at one or more locations in the environment and lighting parameters of one or more light sources may be derived based on the desired effects.

Many light shows include a sequence of slowly changing effects (e.g. color wash, chasing rainbow). These kinds of effects are designed to change the light output from one hue to another (or one intensity value to another) over a period of several frames.

Digital lighting controllers typically send data to light fixtures at some frame rate to modify a light effect setting. Light fixtures generally refresh their output at the same rate sent by the digital light controller. This means that lighting controllers must send data to light fixtures at very high rates in order to ensure that transitions from one frame to the next are not visually perceptible to the viewer. This consumes a great deal of data bus bandwidth. Bandwidth usage is related to the number of light fixtures on the bus and the data frame rate. Because the bus bandwidth is constant, as the number of light fixtures on the bus increases, the frame rate, and thus the refresh rate of the light fixtures, decreases. And so it is often not possible to achieve very high refresh rates in large lighting installations, resulting in choppy light transitions.

In order to avoid unwanted visual artifacts in a lighting show, it is often desirable to have high refresh rates in light fixtures. As the number of lights on the data bus increases, the ability to maintain high refresh rates diminishes. Thus, it is desirable to maintain high refresh rates even with large light installations. Also, some controllers are not capable of sending high frame rate data. Thus, it is also desirable to reduce the visual artifacts produced by these low frame rate controllers.

SUMMARY OF THE INVENTION

The following presents a simplified summary of the invention in order to provide a basic understanding of at least some of its aspects. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention relates to methods and apparatus, including computer program products, for interpolating low frame rate transmissions in lighting systems. Applicant has recognized and appreciated that instead of sending frames to light fixtures at a very high rate, it is often sufficient for the controller to send low frame rate data if the fixture is configured to interpret the light information according to a predetermined scaling scheme.

In general, in one aspect, the invention features a method (100) including, in a microcontroller (22) of a light fixture (14), receiving (102) input data frames at a low frame rate from a light controller (12) over a data bus (16), generating (104) output data frames from any two adjacent input data frames according to a scaling scheme in a lookup table (LUT), and transmitting (106) the output data frames at a frame rate greater than the frame rate of the received input data frames to control a lighting effect of a light-emitting unit (24).

In another aspect, the invention features a lighting system (10) including a light controller (12) having a processor (18) and a memory(20), a light fixture (14) linked to the light controller (12) by a bus (16), the light fixture (14) including a microcontroller (22) linked to a light-emitting unit (24), the microcontroller (22) having a processor (28) and a memory (30), the memory (30) including a frame resampling process (100), the frame resampling process (100) including receiving (102) input data frames at a low frame rate from the light controller (12) over the bus (16), generating (104) output data frames from any two adjacent input data frames according to a scaling scheme in a lookup table (LUT), and transmitting (106) the output data frames at a frame rate greater than the frame rate of the received input data frames to control a lighting effect of the light-emitting unit (24).

The term "light fixture" is used herein to refer to an implementation or arrangement of one or more lighting units in a particular form factor, assembly, or package. The term "light emitting unit" is used herein to refer to an apparatus, such as an SSL or LED lamp, including one or more light sources of same or different types. A given lighting emitting unit may have any one of a variety of mounting arrangements for the light source(s), enclosure/housing arrangements and shapes, and/or electrical and mechanical connection configurations. Additionally, a given lighting-emitting unit optionally may be associated with (e.g., include, be coupled to and/or packaged together with) various other components (e.g., control circuitry) relating to the operation of the light source(s).

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

Various embodiments of the invention will be more fully understood by reference to the detailed description, in conjunction with the following figures, wherein.

In these figures, like reference characters generally refer to the same parts throughout the different views. Also, the figures are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Figure 1:
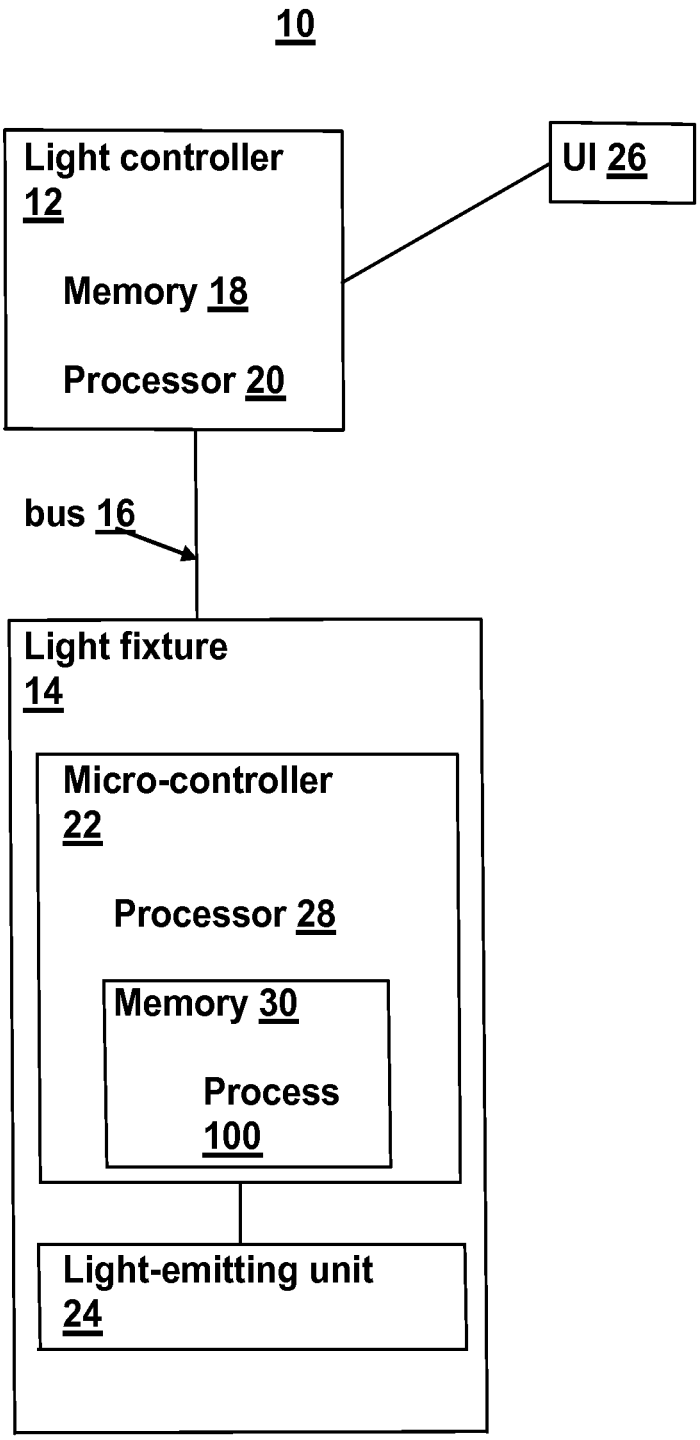
FIG. 1 is a block diagram of an exemplary lighting system.

Referring to FIG. 1, in various embodiments, an exemplary lighting system 10 includes a light controller 12 linked to a light fixture 14 by a digital bus 16. The light controller 12 includes a memory 18 and a processor 20. The light fixture 14 includes a microcontroller 22 linked a light-emitting unit 24. Light-emitting units 24 may include light emitting diodes (LEDs).

As used herein for purposes of the present disclosure, the term "LED" should be understood to include any electroluminescent diode or other type of carrier injection/junction-based system that is capable of generating radiation in response to an electric signal and/or acting as a photodiode. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

Lighting effect commands may be stored in the memory 18 of the light controller 12, which in some examples, can be a Universal Serial Bus (USB) device or a Secure Digital (SD) card. In other implementations, a user interface 26 is provided to enable a user (not shown) to enter lighting effect commands to the light controller 12, which in turn converts the instructions to digital data and sends the digital data as frames of data over the bus 16 to the microcontroller 22 of the light fixture 14.

Communication from the light controller 12 to the microcontroller 22 is in the form of frames, e.g., 8-bit frames, 16-bit frames, and so forth. The frames are sent over the bus 16 at a frame rate, usually defined as frames per second (fps). The data within the frames instruct the microcontroller 22 to alter a lighting effect of the light-emitting unit 24. An example lighting effect is brightness. In general, fast frame rates sent by the light controller 12 to the microcontroller 22 insure smooth transitions of lighting effects of the light-emitting unit 24, e.g., if a smooth show of light from the light-emitting unit 24 is desired, a frame rate should be as fast as possible—this eliminates choppy lighting effect transitions. Whatever frame rate the light controller 12 sends out, the light-emitting unit 24 typically adjusts to at the same rate. However, the faster and larger the frames generated by the light controller 12, the more work imposed upon the light controller 12.

The microcontroller 22 includes a processor 28 and a memory 30. The memory 30 includes a frame resampling process 100 that takes a slow input frame rate of data, interpolates/scales the received frames, and creates a faster frame rate output of data from the microcontroller 22 to the light-emitting unit 24. For example, the frame resampling process 100 may receive two adjacent frames from the light controller 12 at a rate of 4 fps, resample the received frames, and create another 36 frames between each received frame to send to the light-emitting unit 24.

The resampling may be done with any type of linear or non-linear scaling in conjunction with a lookup table (LUT) stored in the memory 30. In other implementations, the LUT is stored in flash memory or ROM in the microprocessor 18. The frame resampling process 100 is a method for reducing the input data frame rate to the light fixture 14 and reducing data bus bandwidth usage, while at the same time ensuring that frame transitions are smooth and free of visual artifacts. Frames received at a slow frame rate by the microcontroller 22 are converted to a series of frames delivered at a higher frame rate to the light-emitting unit 24.

To enable resampling or interpolation by the frame resampling process 100, the light controller 12 sends a signaling frame to the frame resampling process 100 to turn interpolation on. The light controller 12 includes many settings, one of which can be used to signal to the frame resampling process 100 to turn interpolation on. If the turn on interpolation signaling frame is not enabled, the frame resampling process 100 does not execute and the microcontroller 22 handles received frames as usual and passes data along to the light-emitting unit 24 with no interpolation or resampling.

Figure 2:
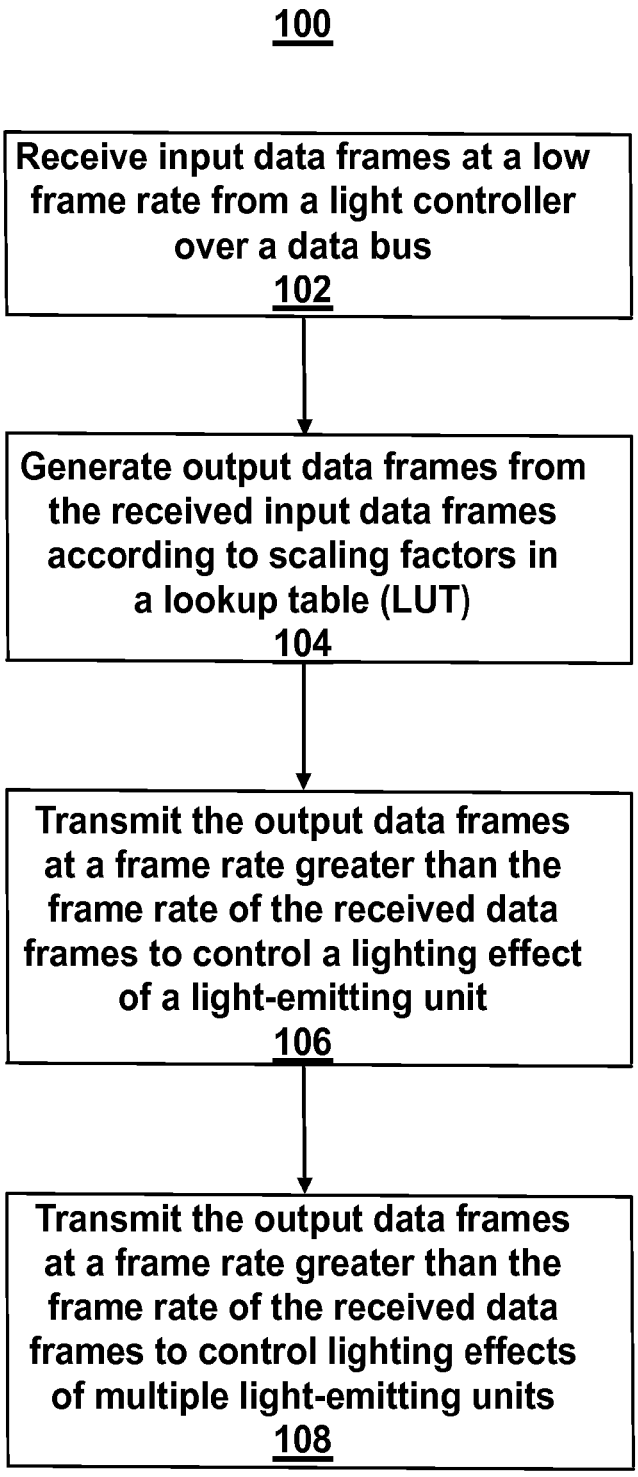
FIG. 2 is a flow diagram of a frame resampling process.

As shown in FIG. 2, the frame resampling process 100 includes receiving (102) input data frames at a low frame rate from a light controller over a data bus. The input data frames contain lighting effect settings. Frame rate can be measured in frames per second (fps).

The frame resampling process 100 generates (104) output data frames from two adjacent received input data frames according to a scaling scheme in a lookup table (LUT). The output data frames contain lighting effect settings. The scaling scheme can be any type of linear or non-linear scaling, such as, for example, linear, quadratic, cubic, logarithmic or combinations thereof. In one example, the LUT includes a maximum scaling factor, a time index and a maximum time index. In other examples, the LUT includes specific mappings of values of input frames to values of output frames.

Generating (104) each of the output data frames can include scaling a difference between two adjacent input data frames.

The frame resampling process 100 transmits (106) the output data frames at a frame rate greater than the frame rate of the received data frames to control a lighting effect of a light-emitting unit.

The frame resampling process 100 can transmit (108) the output data frames at a frame rate greater than the frame rate of the received data frames to control lighting effects of multiple light-emitting units.

Figure 3:
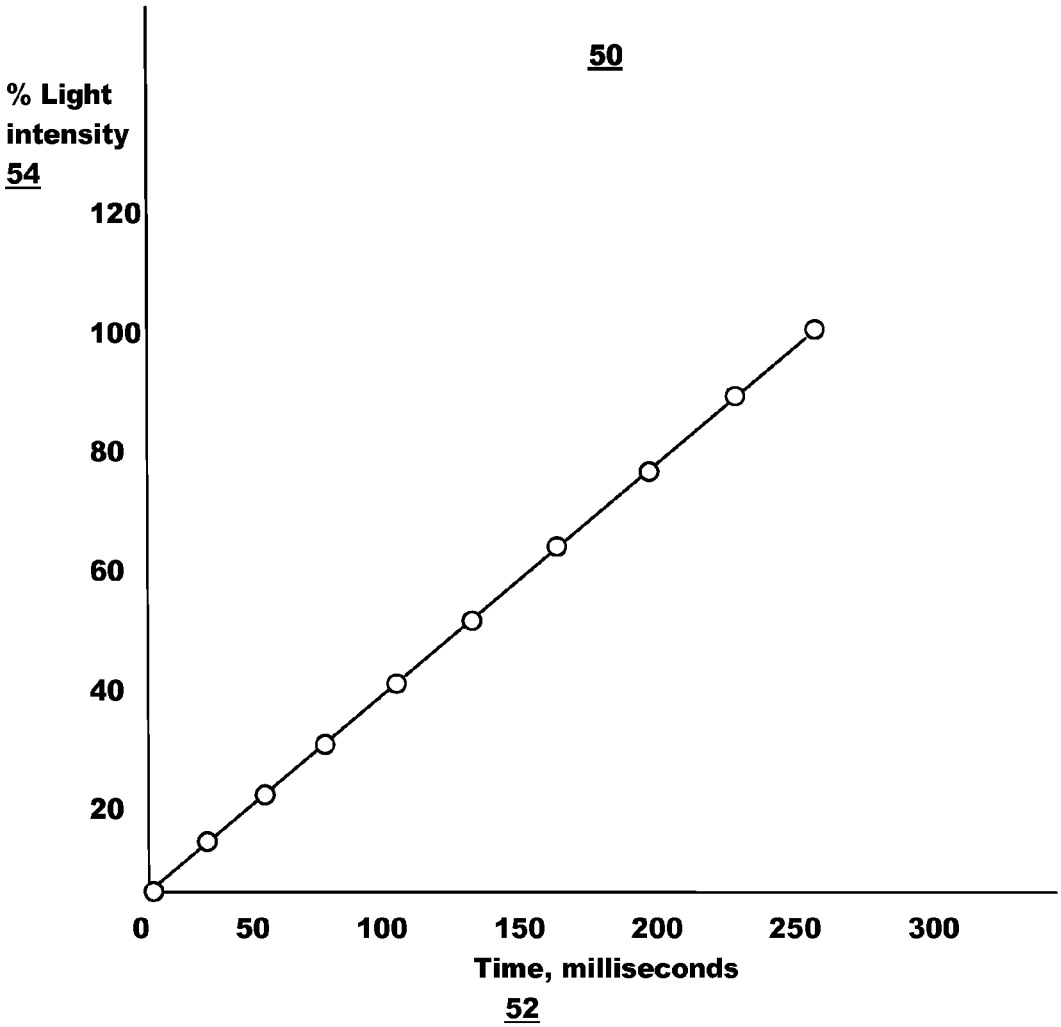
FIG. 3 is an exemplary graph without the frame resampling process.

As shown in FIG. 3, an exemplary graph 50 plots time 52 in milliseconds against % light intensity 54 and illustrates how the light controller 12 fades light from off to full on by sending frame rate data to the light fixture 14 without the frame resampling process 100. In this example, light output of the light-emitting unit 24 increased from 0% to 100% by sending ten frames of data (shown as circles) at 40 Hz. More specifically, the graph 50 illustrates the light controller 12 sending ten frames of input data to the microcontroller 22 at an input frame rate and the microcontroller 22 transmitting the same ten frames to the light-emitting unit 24 at the same frame rate, i.e., ten frames at 40 Hz in and ten frames at 40 Hz out. Thus, in this example, the input rate of frames and the output rate of frames are equivalent.

Figure 4:
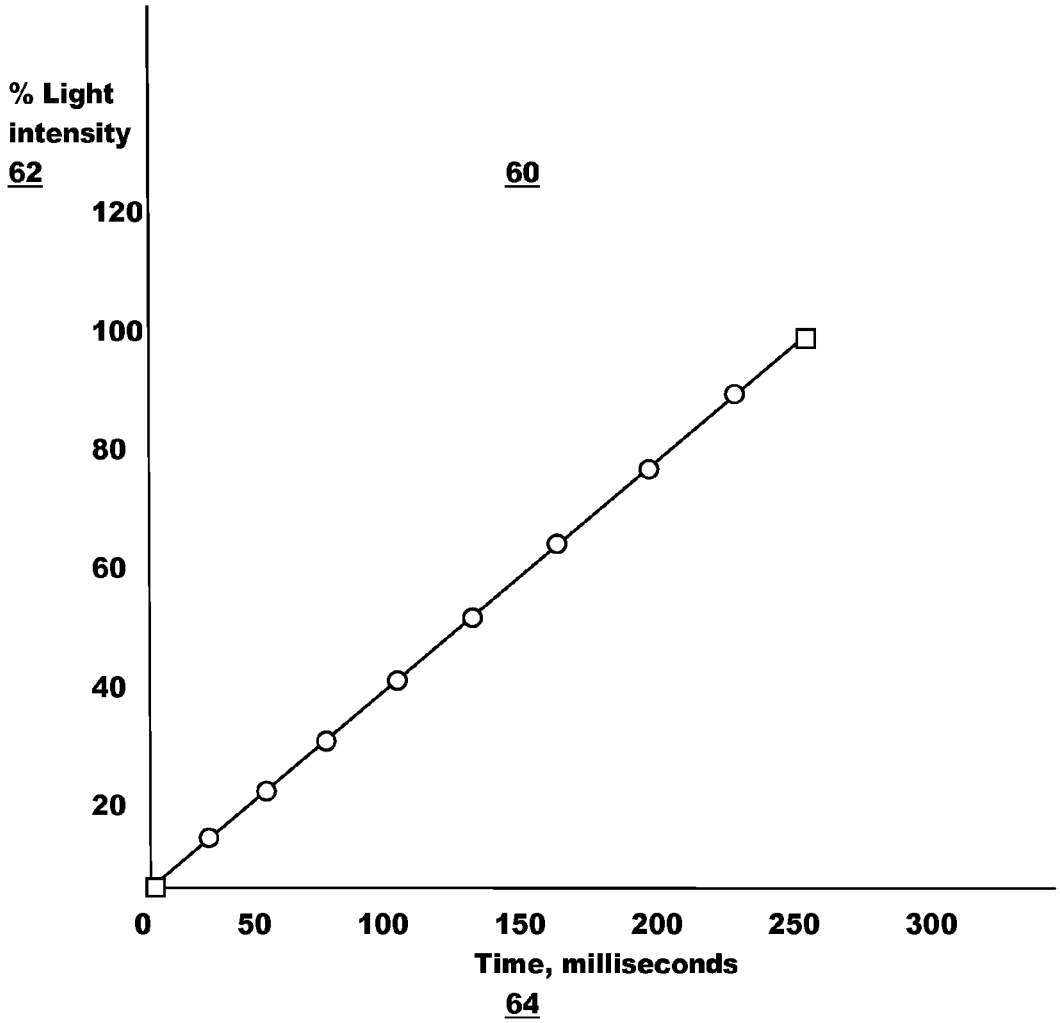
FIG. 4 is an exemplary graph with the frame resampling process.

As shown in FIG. 4, an exemplary graph 60 plots time 62 in milliseconds against % light intensity 64 and illustrates how the light controller 12 fades light from off to full on by sending low frame rate data to the light fixture 14 with the frame resampling process 100 enabled. In this example, light output of the light-emitting unit 24 increased from 0% to 100% by sending two frames of data at 4 Hz (shown as squares) to the light fixture 14, i.e., a first frame at time=0 and a second frame at time=250 milliseconds. The frame resampling process 100 interpolates the data contained in the two received adjacent frames in conjunction with a scaling scheme stored in a LUT and outputs multiple frames (shown as circles) to the light-emitting unit 24 at a higher frame rate, i.e., ten output frames generated and transmitted between a time=0 and a time=250 milliseconds to the light-emitting unit 24. More generally, each time the microcontroller 22 executes it must compute the value of the output frame. It does this by scaling the difference between two received adjacent input frames. The scale factors of the scaling scheme, i.e., the interpolation path, can be determined by a LUT. In graph 60, if new_frame and old_frame are the adjacent input frames received from the light controller 12, then the frame resampling process 100 may generate interpolated output frames using the following equations.

$$\text{output_frame}=([(\text{new_frame}-\text{old_frame})\times\text{LUT}[\text{time_index}]]/\text{max_scale_factor})+\text{old_frame} \quad (1)$$

$$\text{time_index}=\text{time_index}+\text{time_increment} \quad (2)$$

Equations (1) and (2) assume that new_frame is greater than old_frame. If old_frame is greater than new_frame, then an analogous set of equations may be used, such as the following.

$$\text{output_frame}=([(\text{old_frame}-\text{new_frame})\times\text{LUT}[\text{time_index}]]/\text{max_scale_factor})+\text{new_frame} \quad (3)$$

$$\text{time_index}=\text{time_index}+\text{time_increment} \quad (4)$$

The value of time_increment may be increased in order to reduce the effective interpolated refresh rate.

Once time_index equals (or exceeds) max_time_index, the output_frame should saturate at new_frame.

The example described above is a linear interpolation in which the light-emitting unit 24 is instructed to go from off to full on. The frame resampling process 100 is not limited to linear interpolations; any type of linear or non-linear scaling may be used. The frame resampling process 100 can also process non-linear interpolations where a non-linear lighting effect is desired, such as a slow gradual rise in color from off to slight red, a decrease in color, and then another increase in color. To accomplish this non-linear effect, the light controller 12 can signal the frame resampling process 100 to turn interpolation on, and interpolate any two received adjacent input data frames with different scaling schemes stored in different LUTs. Storing different LUTs enable the frame resampling process 100 to handle different interpolation schemes, such as quadratic interpolation, cubic interpolation, logarithmic interpolation and so forth.

The frame resampling process 100 may use these different interpolation methods when increasing or decreasing the intensity of the light-emitting unit. For instance, linear interpolation may be used when the light fades up, but quadratic interpolation may be used when the light fades down. The frame resampling process 100 may be enabled on a light fixture without any modifications to the light controller. It is also possible for the light controller to explicitly send extra data to the light fixture along with frame data. This extra data may be used to configure the frame resampling process 100. For example, the lighting controller 12 may configure an interpolation scheme and speed on a frame-by-frame basis by sending this information with the frame data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing between parentheses in the claims are provided merely for convenience and should not be construed as limiting the claims in any way.

What is claimed is:

1. A method comprising:

in a microcontroller of a light fixture, receiving a plurality of input data frames at a low frame rate from a light controller over a data bus;

generating a plurality of output data frames from any two adjacent input data frames of the plurality of input data frames according to a scaling scheme in a lookup table; and transmitting the plurality of output data frames at a frame rate greater than the frame rate of the received plurality of input data frames to control a lighting effect of a light-emitting unit.

2. The method of claim 1 wherein the scaling scheme is selected from the group consisting of linear, quadratic, cubic and logarithmic.

3. The method of claim 1 wherein the LUT comprises a maximum scaling factor, a time index and a maximum time index.

4. The method of claim 3 wherein generating each of the plurality of output data frames comprises scaling a difference between two adjacent input data frames.

5. The method of claim 4 wherein scaling the difference between two adjacent input data frames comprises:

generating an output frame equaling ([(a second input data frame value−a first input data frame value)×the time index]]/the maximum scaling factor)+the first input data frame value; and the time index =the time index+a time increment value.

6. The method of claim 5 further comprising increasing the time increment value to reduce an effective interpolated refresh rate.

7. The method of claim 4 wherein scaling the difference between two adjacent input data frames comprises:

generating an output frame equaling=([(a first input data frame value−second input data frame value)×the time index]]/maximum scaling factor)+the second input data frame value; and the time index=the time index+a time increment value.

8. The method of claim 7 further comprising increasing the time increment value to reduce an effective interpolated refresh rate.

9. The method of claim 1 wherein the plurality of output data frames contain lighting effect settings.

10. The method of claim 1 wherein transmitting the plurality of output data frames at a frame rate greater than the frame rate of the received first plurality of data frames controls lighting effects of a plurality of light-emitting units.

11. A lighting system comprising:

a light controller comprising a processor and a memory;

a light fixture linked to the light controller by a bus;

the light fixture comprising a microcontroller linked to a light-emitting unit, the microcontroller comprising a processor and a memory, the memory comprising a frame resampling process, the frame resampling process comprising:

receiving a plurality of input data frames at a low frame rate from the light controller over the bus;

generating a plurality of output data frames from any two adjacent input data frames of the plurality of input data frames according to a scaling scheme in a lookup table stored in the memory of the microcontroller; and transmitting the plurality of output data frames at a frame rate greater than the frame rate of the received plurality of input data frames to control a lighting effect of the light-emitting unit.

12. The lighting system of claim 11 wherein the scaling scheme is selected from the group consisting of linear, quadratic, cubic and logarithmic.

13. The lighting system of claim 11 wherein the LUT comprises a maximum scaling factor, a time index and a maximum time index.

14. The lighting system of claim 13 wherein generating each of the plurality of output data frames comprises scaling a difference between two adjacent input data frames.

15. The lighting system of claim 14 wherein scaling the difference between two adjacent input data frames comprises:

generating an output frame equaling ([(a second input data frame value−a first input data frame value)×the time index]]/the maximum scaling factor)+the first input data frame value; and the time index=the time index+a time increment value.

16. The lighting system of claim 15 further comprising increasing the time increment value to reduce an effective interpolated refresh rate.

17. The lighting system of claim 14 wherein scaling the difference between two adjacent input data frames comprises:

generating an output frame equaling=([(a first input data frame value−second input data frame value)×the time index]]/the maximum scaling factor)+the second input data frame value; and the time index=the time index+a time increment value.

18. The lighting system of claim 17 further comprising increasing the time increment value to reduce an effective interpolated refresh rate.

19. The lighting system of claim 11 wherein the plurality of output data frames contain lighting effect settings.

* * * * *